United States Patent [19]

Maselli et al.

[11] 4,333,408

[45] Jun. 8, 1982

[54] MACHINE FOR MANUFACTURING PANTYHOSE WITH GUSSET

[76] Inventors: Maria Maselli; Alberto Frullini, both of Via di Brozzi 151 A; Meri Elbetti, Via G. Oberdan 24, S. Donnina; Luisa Frullini, Via B. della Gatta 14, all of Florence, Italy

[21] Appl. No.: 91,741

[22] Filed: Nov. 6, 1979

Related U.S. Application Data

[63] Continuation-in-part of Ser. No. 46,928, Jun. 8, 1979, abandoned.

[51] Int. Cl.[3] ..... D05B 21/00; D05C 9/04; D05C 9/10

[52] U.S. Cl. ..... 112/121.15; 112/121.12

[58] Field of Search ..... 112/121.15, 121.11, 112/121.12; 223/43

[56] References Cited

U.S. PATENT DOCUMENTS

| | | | |
|---|---|---|---|
| 3,669,047 | 6/1972 | Hedegaard | 112/121.15 |
| 3,777,681 | 12/1973 | Horita | 112/121.15 |
| 4,135,459 | 1/1979 | Manabe et al. | 112/121.12 |
| 4,135,464 | 1/1979 | Sanvito | 112/121.15 |
| 4,188,898 | 2/1980 | Bell et al. | 112/121.15 |
| 4,224,885 | 9/1980 | Takatori | 112/121.15 |

*Primary Examiner*—Ronald Feldbaum

*Attorney, Agent, or Firm*—McAulay, Fields, Fisher, Goldstein & Nissen

[57] ABSTRACT

A machine for manufacturing pantyhose with a gusset, which is provided retractor devices and clamps that operate in conjunction with each other to (1) deliver a gusset to the stocking, (2) hold it in place, and (3) sew it to the pantyhose. A clamping and holding device delivers the gussets one at a time, as required, to the sewing station where the pantyhose halves are held and stretched. The pantyhose parts are assembled by sewing.

7 Claims, 27 Drawing Figures

FIG. 19
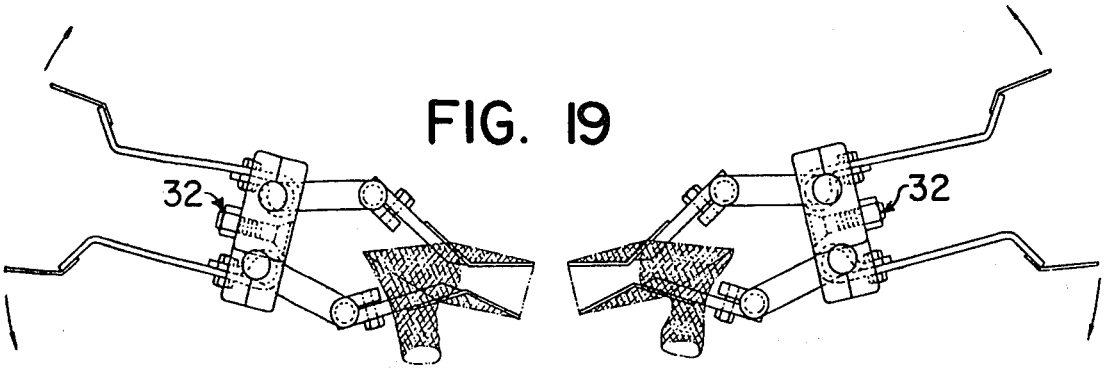
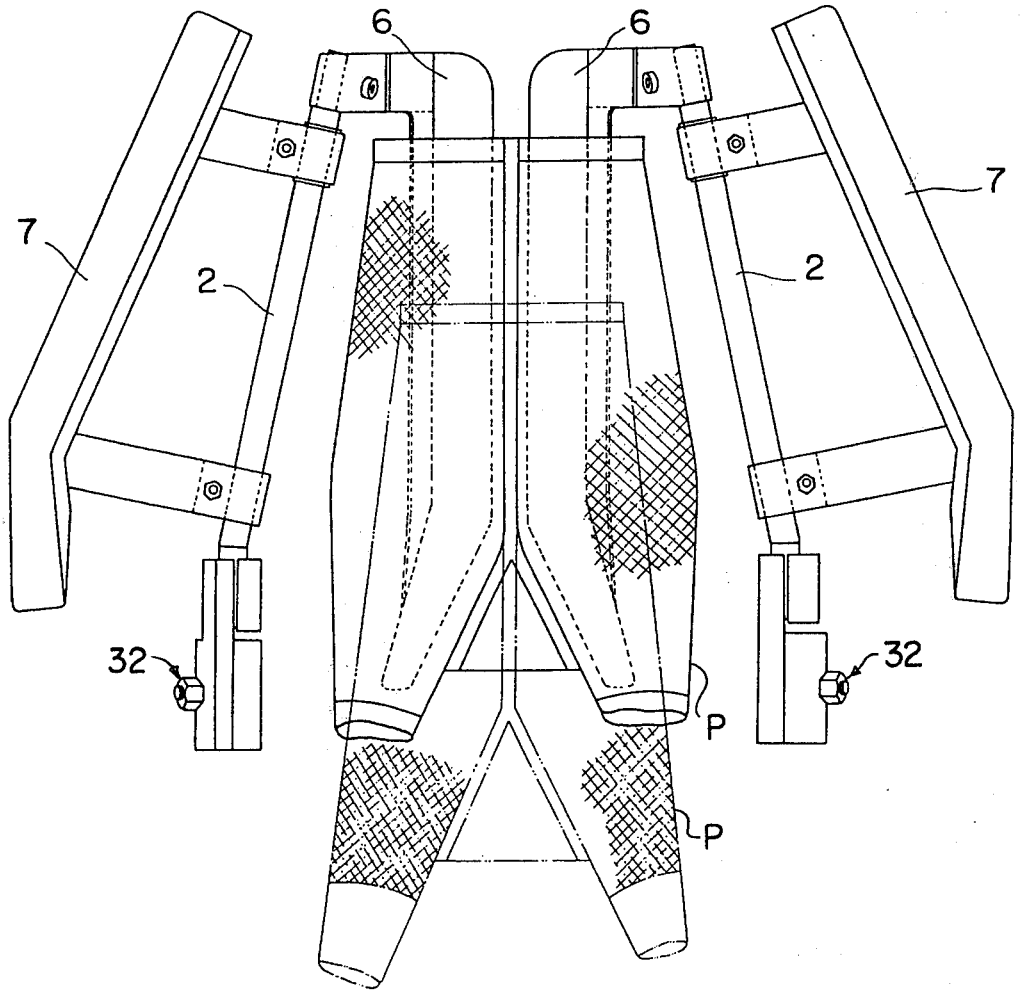
FIG. 18

MACHINE FOR MANUFACTURING PANTYHOSE WITH GUSSET

CROSS REFERENCE TO RELATED APPLICATION

This is a continuation-in-part of United States patent application Ser. No. 046,928 filed June 8, 1979 now abandoned, by the same Inventors hereof.

BACKGROUND OF THE INVENTION

The present invention is concerned with an improvement to machines used for the manufacture of pantyhose. More particularly, the present invention is concerned with apparatus for supplying, holding, and sewing reinforcing gussets to the pubicsacral region of the pantyhose.

Pantyhose, as is well known, is a hybrid undergarment which combines underpants with stockings into a single unit. The convenience of using such a combined garment has led to a great consumer demand for them.

In general, pantyhose are manufactured by using a cutting and sewing machine which acts to match the portions of two separate stocking halves to be combined to form the pantyhose. The two halves are then sewn together at the overlapped edges to form a median and longitudinal seam. This operation is accomplished by known means using the cutting and sewing machine.

However, the heretofore known method of forming pantyhose from two stocking portions does not provide for automatically applying a reinforcing band or gusset, especially to the area between the downwardly extending leg portions. When prior stockings are worn, the fabric elasticity adapts the tubular shape of the product to the more complex shape of the person wearing the stocking. As can readily be appreciated, this stretching of the material to conform to the body of the user oftentimes results in a premature failure of the pantyhose.

By applying a reinforcing band of material or gusset to the pantyhose, one can obtain a pantyhose with extended wear qualities. In addition, the resulting pantyhose is esthetically more elegant. Commercially, the use of a gusset permits greater latitude in forming the pantyhose, especially in that a larger size pantyhose can be made from the same stocking halves because the fabric does not require initial trimming along the cut.

It is an important object of the present invention to provide a device using an automated procedure for applying a gusset to pantyhose whereby to obtain a large output of finished products.

BRIEF DESCRIPTION OF THE INVENTION

Briefly, the present invention is in a device which holds the stocking halves to be sewn together to form the pantyhose, along with the reinforcing band or gusset, in mutually superposed and complementary relationships, so that the pantyhose can be sewn together with the gusset in place. To attain the objects of the present invention, there is provided a clamping and holding device for delivering the gussets, one at a time, from their distribution device to the sewing station; a device for predisposing the stocking halves on their appropriate holding and retracting units; and a device for stretching the edges of the two halves to be sewn together to form the finished pantyhose. A sewing machine secures the parts together, and the finished pantyhose is then removed from the device for packaging, preferably using pneumatic transport means.

Other objects, advantages and the nature of the machine for manufacturing pantyhose with a gusset will become readily apparent to those skilled in the art from the detailed description of the invention and the various component parts thereof taken in connection with the accompanying drawings.

BRIEF DESCRIPTION OF THE DRAWINGS

In the drawings:

FIG. 18 shows the retractor apparatus of FIG. 1 in its closed attitude and with the jaws wide open and the finished product being ejected. The finished product is shown in full outline on the jaws, and the finished product is shown in dot-dashed outline in the process of being ejected for removal from the retractor apparatus;

FIG. 19 is an elevational view of the device as shown in FIG. 18;

DESCRIPTION OF THE PREFERRED EMBODIMENT

Figure 3:
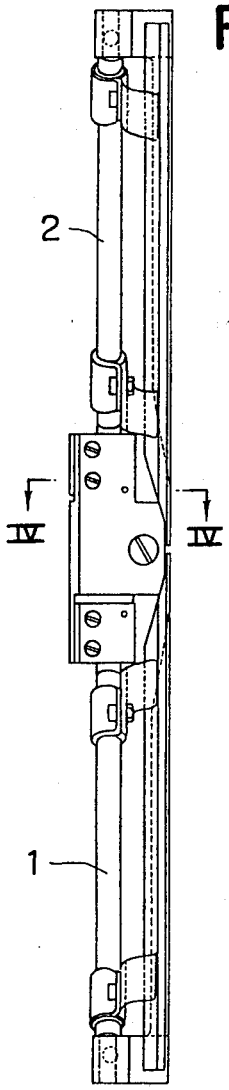
FIG. 3 is a side and sectional view of the retractor apparatus looking in the direction of line III—III of FIG. 1.
Figure 4:
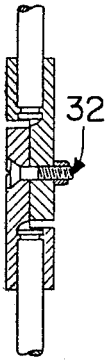
FIG. 4 is a sectional view taken through line IV—IV of FIG. 3.
Figure 11:
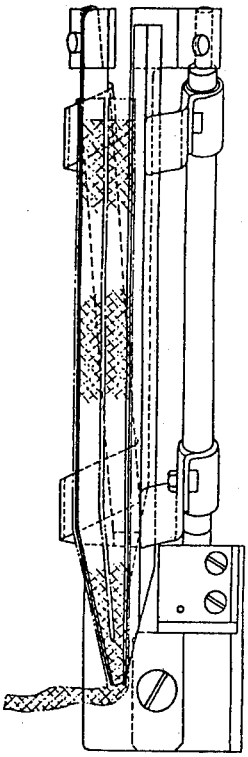
FIG. 11 is a sectional view of the apparatus taken along line XI—XI of FIG. 9. This sectional view is taken in the same manner as the sectional view of FIG. 3.
Figure 10:
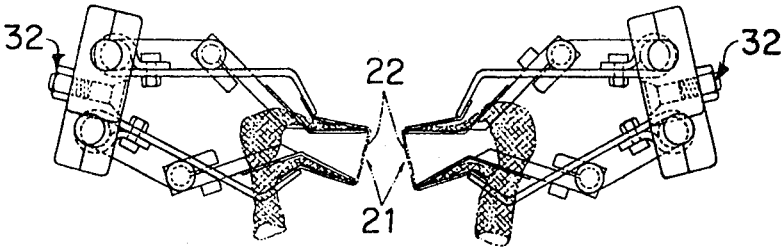
FIG. 10 is an elevational view of the retractor apparatus as shown in FIG. 9.
Figure 12:
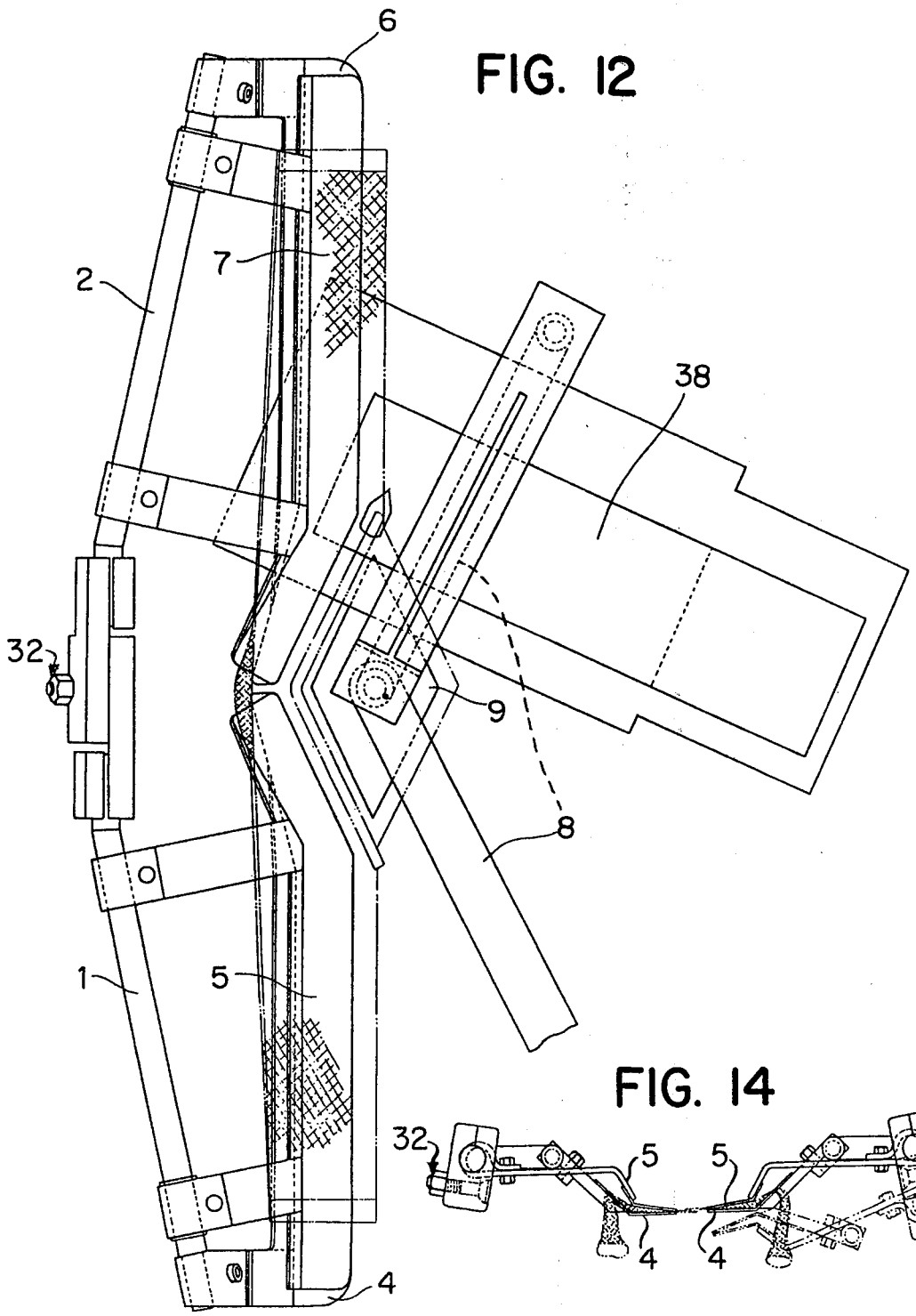
FIG. 12 shows the left side unit of the retractor apparatus of FIG. 1 in its open position with the band or gusset carrier arm and the sewing unit in place during the sewing operation of the first half of the band or gusset. The right half side unit which is identical has been omitted for the purpose of clarity and ease of understanding.
Figure 14:
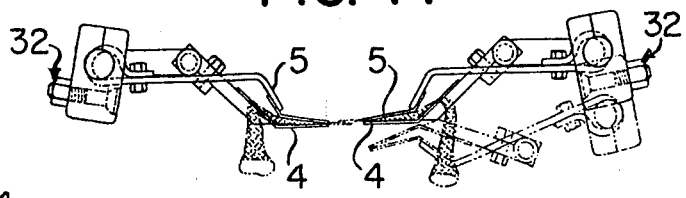
FIG. 14 shows an elevational view of the retractor apparatus as shown in FIG. 13.
Figure 13:
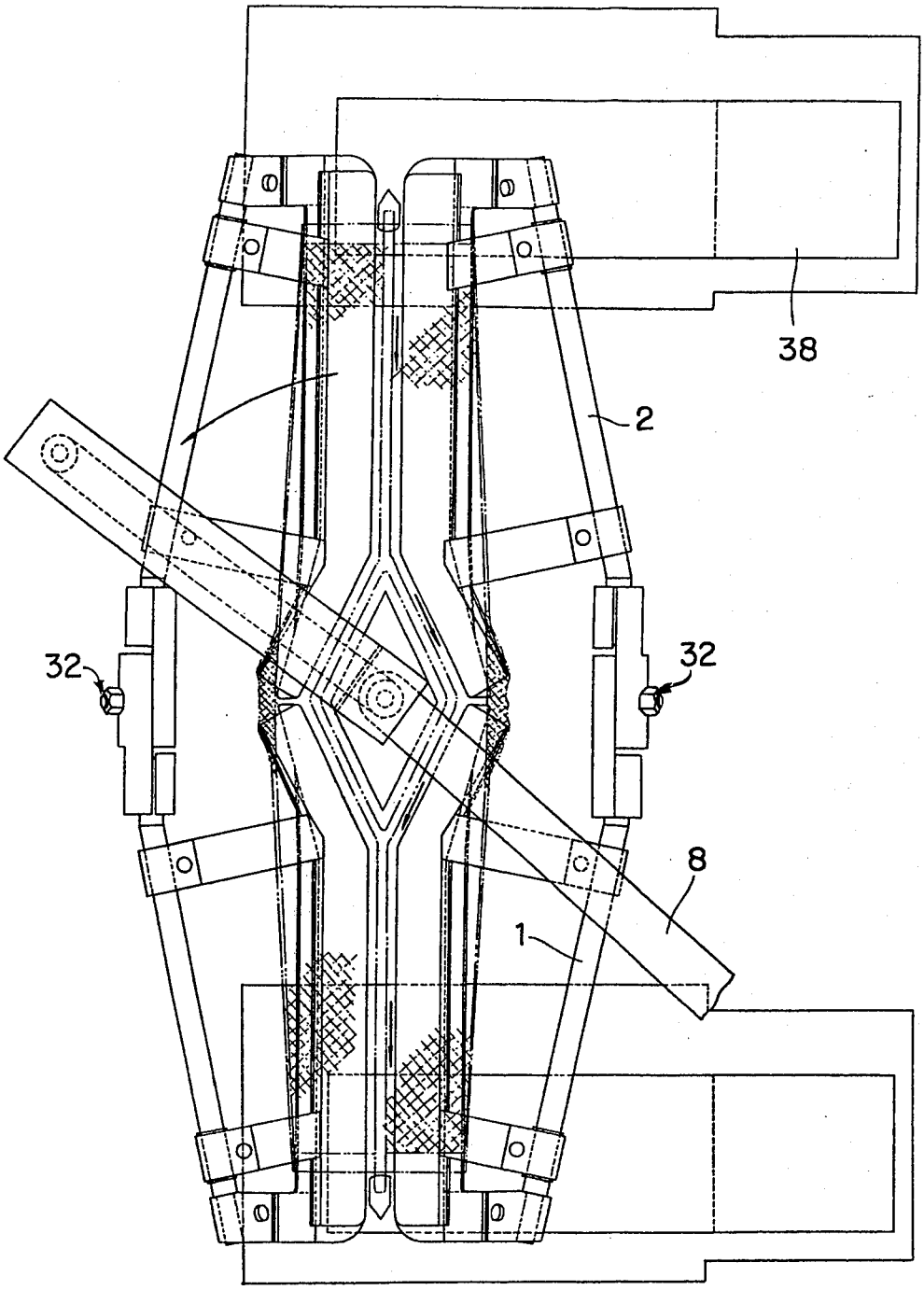
FIG. 13 shows the retractor apparatus of FIG. 1 in its open position with the half part of the reinforcing band or gusset already sewed in and the sewing unit during the sewing operation of the stockings to the last part of the reinforcing band.
Figure 16:
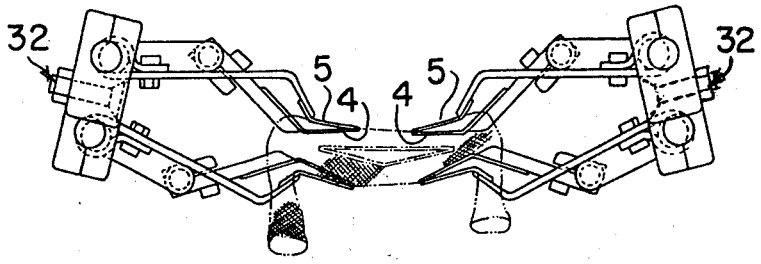
FIG. 16 shows an elevational view of the retractor apparatus as shown in FIG. 15.
Figure 17:
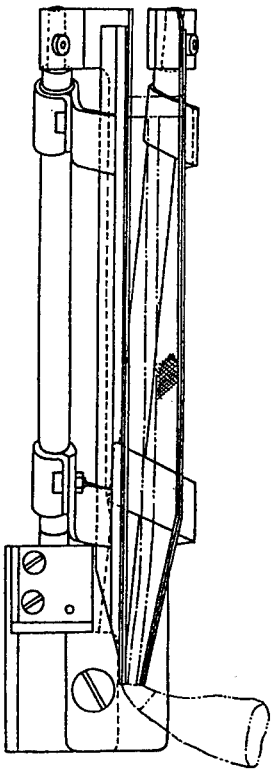
FIG. 17 is a view of the retractor device as shown in FIG. 15 taken along XVII—XVII of FIG. 15; in the same manner as FIG. 3.
Figure 15:
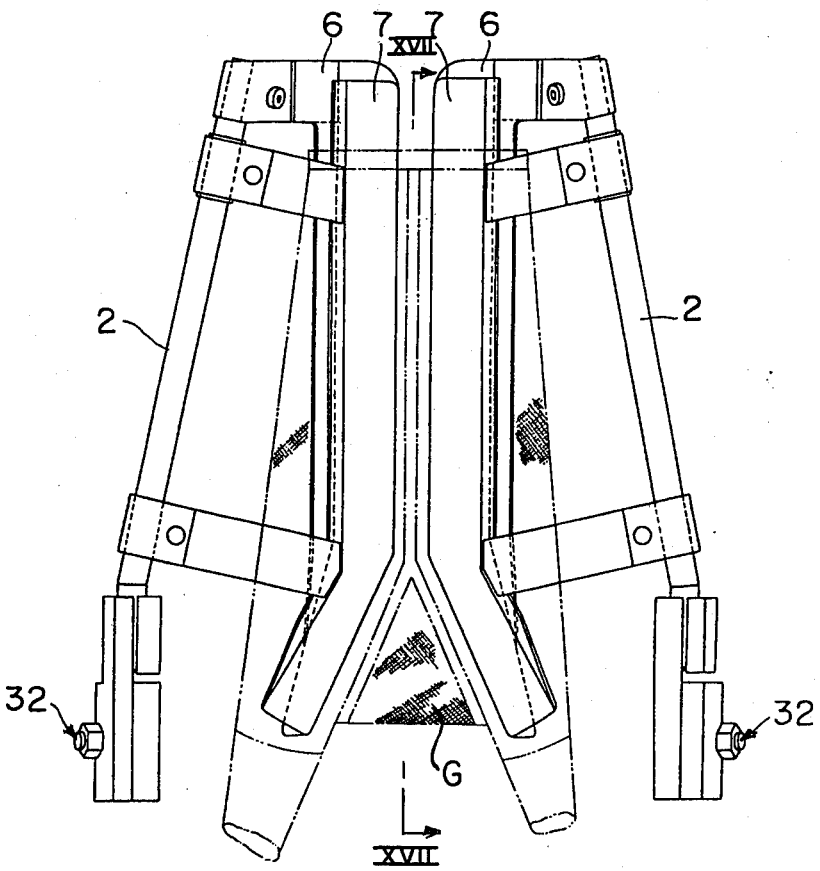
FIG. 15 shows a plan view of the retractor apparatus of FIG. 1 in its closed attitude at which time the product is still held between the closed clamping jaws.

Referring now more particularly to the drawings which illustrate the presently preferred mode for carrying out the invention. Specifically, for ease of understanding, the drawings are grouped into sets of figures which are related to each other in accordance with different sequences of operation. Specifically, Group I includes FIGS. 1, 7, 9, 12, 13, 15, 18 and 21 which show the same plan view of the retractor apparatus in various progressive stages of production. Group II which includes FIGS. 2, 8, 10, 14, 16, 19, 23, which show the front elevational view, also in progressive stages of production; and, Group III which includes FIGS. 3, 11, 17, are also views of progressive states of production but showing the retractor apparatus looking into it from the center axis.

Figure 1:
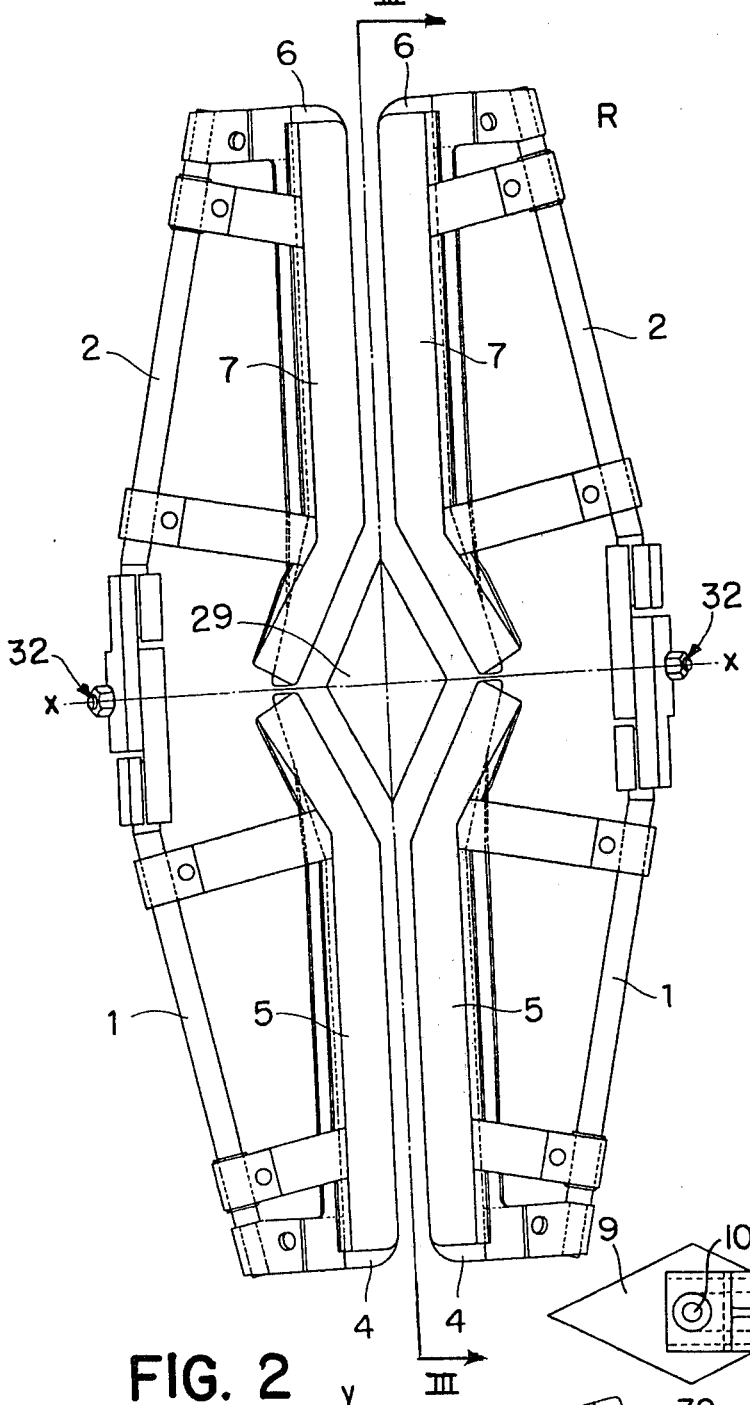
FIG. 1 is a plan view of retractor apparatus for a machine according to the present invention, the retractor apparatus being shown wide open with its jaws closed.
Figure 2:
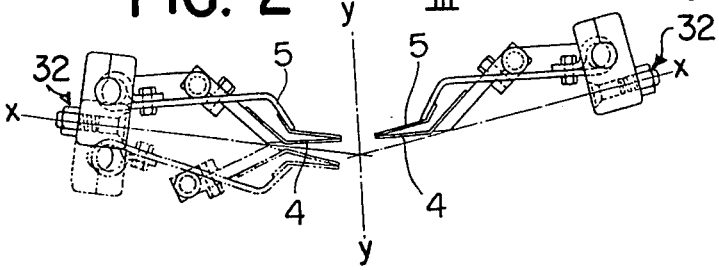
FIG. 2 is a front elevational view of the apparatus of FIG. 1.

Referring now more particularly to FIGS. 1 through 19, the invention relates to a machine for manufacturing pantyhose 20 with reinforcing bands or gussets G, which includes a plurality of retractor apparatus each of which is made up of two independent units equal to each other and symmetrically located with respect to a vertical longitudinal axis "Y—Y" (FIG. 2). Axis Y—Y coincides with the section line III—III. Each of the two independent units is formed by two retractor arms 1, 2, connected by a hinge 32 to permit either rotation, folding of the arms 1, 2 around a transversal axis "X—X" or, alternatively, to be opened wide apart. Pairs of jaws 4, 5 and 6, 7 are integral to each of arms 1, 2 respectively. One jaw of each pair 4, 6, is fixed and supported by arms 1, 2 in a cantilever manner; and the other jaw of each pair 5, 7 is pivotably mounted with respect to its respective arm 1, 2. Each tubed stocking half is supported on the first of the jaws 5, 7 and clamped by the second, rotatably mounted, jaw 4, 6.

As can be seen in FIG. 1, the external rib of the jaws 5, 7 is suitably shaped to form an obtuse angle which makes up a V-shaped cavity having a size corresponding to and conforming to that of the gusset to be applied. Furthermore, when retractor 12 is closed, the cantilever mounted jaws 4, 6 by being folded adjacent each other can be adjusted to vary the fabric width projecting from the jaws during sewing; and the axis "X—X" is inclined with respect to the horizontal plane to make the cantilever mounted jaws 4, 6 co-planar when the retractor arms 1, 2 are aligned.

Figure 6:
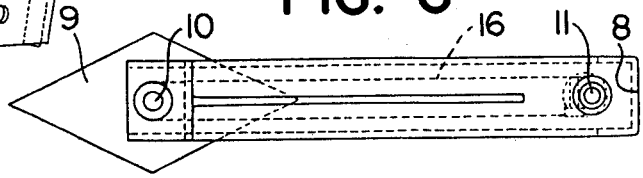
FIG. 6 is a top plan view of the apparatus shown in FIG. 5.
Figure 5:
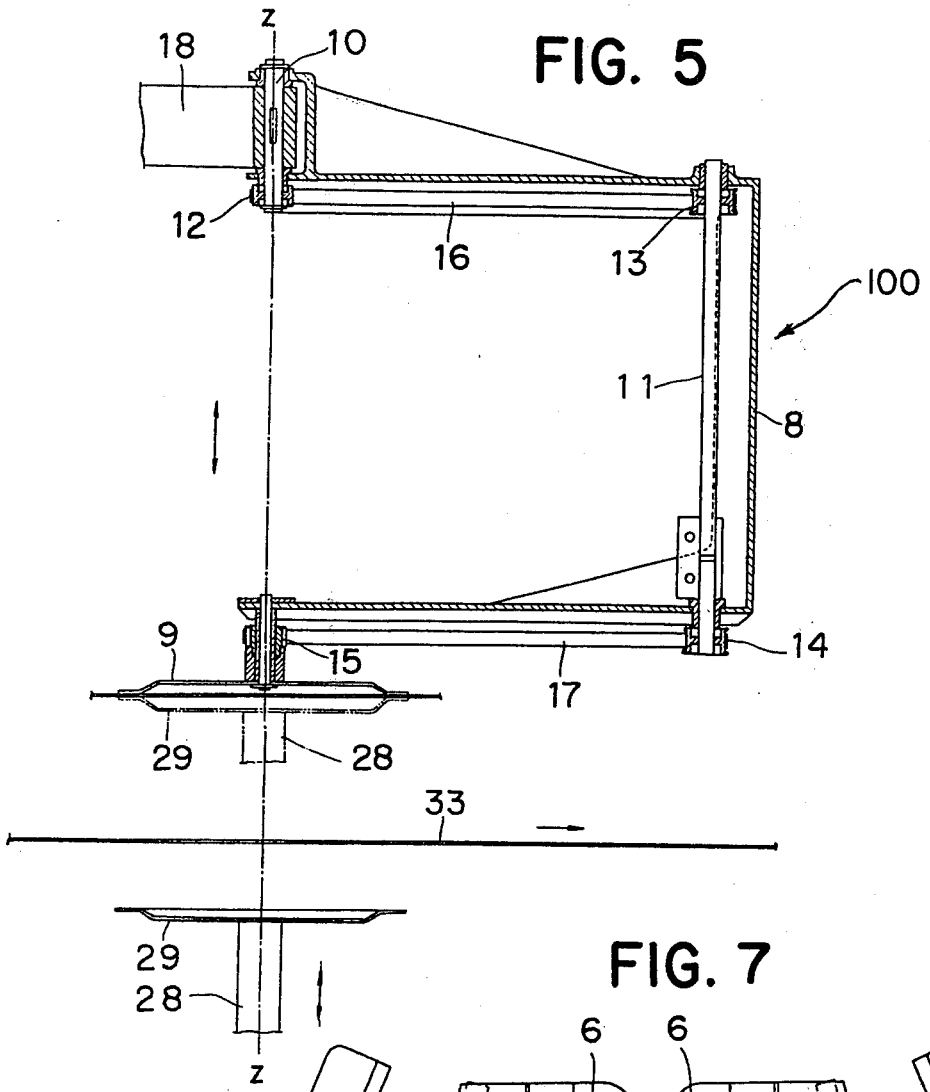
FIG. 5 is an elevational view of a gusset or reinforcing band carrier which cooperates with the retractor apparatus for applying the gusset to the pantyhose.

With reference to FIGS. 5 and 6, gusset carrier device 100 includes a goose neck bracket 8 having its upper part hinged to machine housing 18 and rotatable about vertical axis "Z" which axis passes through the ends of the bracket 8. Bracket 8 carries, at its lower end, a cantilever supported upper plate 9 having a shaped rib or shaped outer edge configuration sized to correspond to the shape of the gusset—normally rhombic or similarly outlined—that must be held thereon. At its other end, bracket 8 is engaged or connected with a shaft 10 by means of shaft 11, gears 12, 13, 14 and 15, and two chain or drive belts 16, 17, so that horizontal rotation of bracket 8 can be accomplished without rotating plate 9. This permits the sewing unit to transfer, during sewing, from one side of the gusset to one tube and the other side of the gusset to the other tube.

In order to permit bracket 8 to be moved vertically to move it out of the way of the operation of various retractor devices (as will be discussed in detail below), an arm 28 is provided, to which is imparted a vertical reciprocating motion. Arm 28 carries a free or lower plate 29 similar to plate 9. Plate 29 is used for delivering to plate 9 a gusset from a gusset supply before each sewing phase and for recovering the plate after the sewing of the gusset. The lower plate 29 which carrys the gusset thereon is held by means of the upper plate 9 by means of magnetic or pneumatic attraction of the lower plate 29. Alternatively, the lower plate 29 can be a one use device made of paper or other similar material to be thrown away or disposed of after use.

Sewing of the pantyhose into an assembled unit is accomplished by using a usual sewing arm unit having a plurality of needles and being guided for movement by known means to sew first one half of the gusset and then the remaining half of the gusset to the stocking or tubes 20.

A machine according to the present invention may use known means for separately cutting the stockings which have been tubed or slipped over onto the fixed jaws 4, 6 of the two retractor devices along the median plane "B—B" (FIG. 8) as required.

However, the preferred embodiment incorporates a number of additional automated devices whereby a finished pantyhose garment can be formed more quickly and under automated conditions. The details of these various devices include a device for taking gussets, one at a time, from their distribution devices, delivering them to the sewing station, and holding them in place during the first sewing step—the step wherein the first half of the gusset and stocking seam are sewn; a device for disposing the stockings on the stocking retractor, and shaping the profile of the edge and adjust it, as required, for sewing; and a device for stretching the edges of the two stockings to be sewn, along the whole length to be sewn, thereby to hold the stocking in an appropriate position for sewing.

Figure 20:
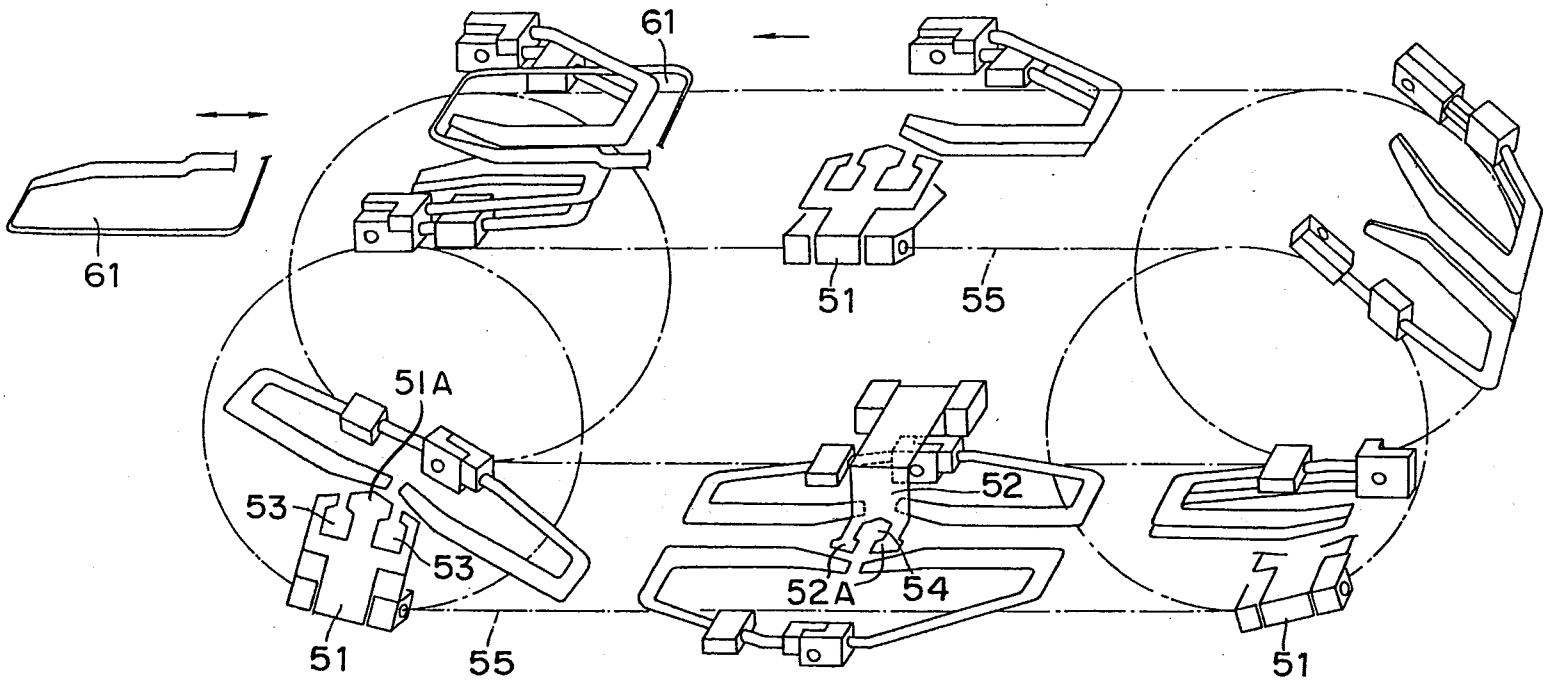
FIG. 20 is an axonometric view of the gusset holding device for withdrawing the retractor apparatus holding the gusset, and with the apparatus for holding and aligning the stockings in the retractor apparatus.
Figure 23:
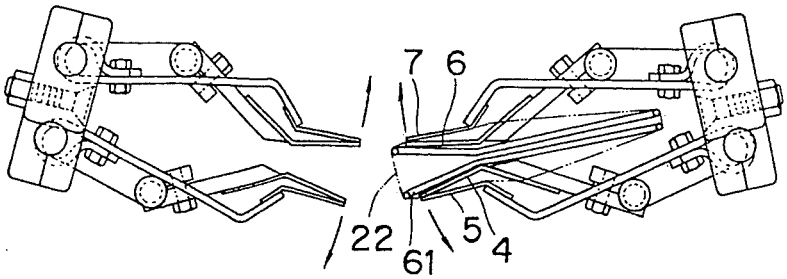
FIG. 23 is an elevational view of the retractor apparatus as shown in FIG. 21.
Figure 21:
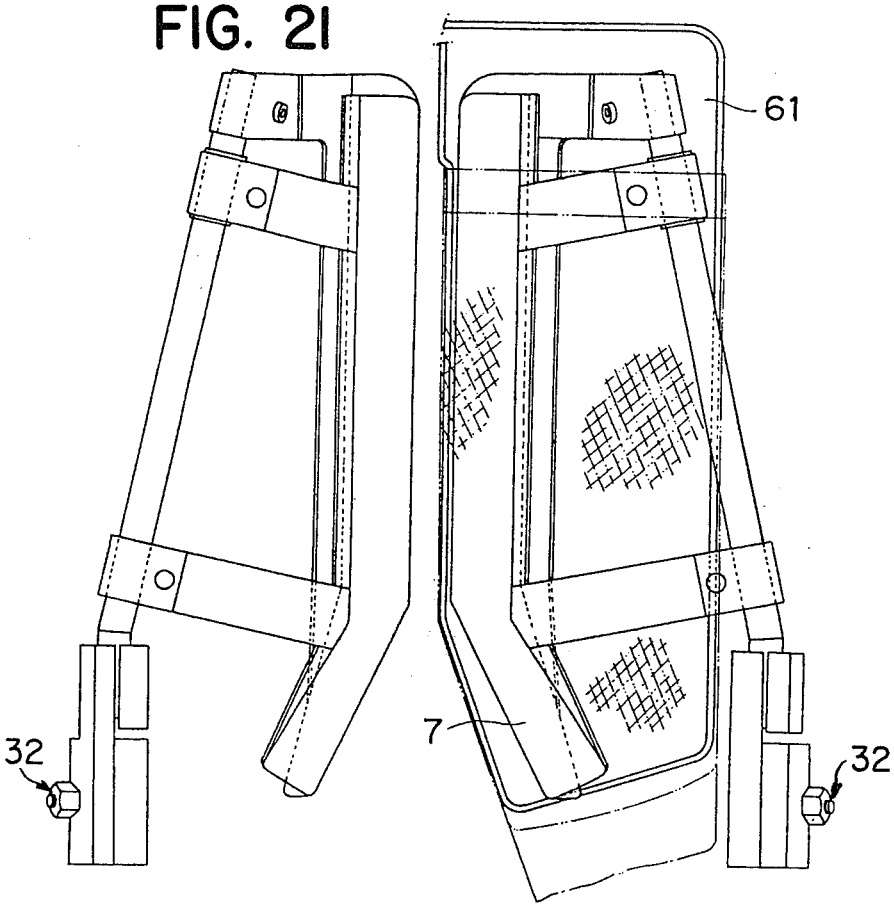
FIG. 21 is a plan view of the retractor apparatus of FIG. 1, showing the right retractor portion for the predisposition of stockings, with the stockings in place.
Figure 22:
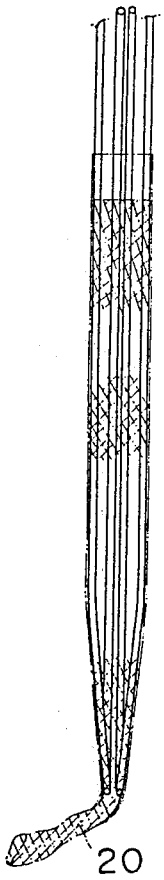
FIG. 22 is a side view of the right side of the retractor apparatus as shown in FIG. 21.

Referring now more particularly to FIG. 20 which shows the device for taking the gussets, one at a time, from the distribution device and delivering them to the sewing station, this device includes a plurality of clamps 51 and a single clamp 52, each of which separately holds a gusset during the sewing of half of its perimeter. As can be seen from FIG. 20, first clamp 51 has two flat jaws with openings 53 and a central head in the form of an isosceles triangle. The apex angle of the triangle is equal to the largest angle of the rhombic shaped gusset that is to be used, and the longitudinal size of the head is to correspond to the length of the gusset. The second clamp 52 also includes two flat jaws 52A, 52A and a central opening 54, which are all sized to permit interpenetration of clamps 52 into the openings 53 of clamp 51. The head 51A of the first clamp or pliers 51 fits into the opening 54 of clamp 52.

Each of clamps 51 is integral with a respective transfer means 55 of a retractor unit of one of the stockings halves making up the finished product. The second clamp 52 is positioned at the sewing station and is removable. The dimensions and relative positions of clamps 51, 52 are such that when they clamp the gusset, only a narrow edge of the gusset along half of its perimeter projects. The movement of clamps 51 is in unison with the intermittent feed motion of transfer means 55 with which it is integral, and is such that only one of the two clamps 51, 52, at any one time, is holding the gusset. Thus, the sewing of the gusset on the first stocking begins and finishes while being held by clamp 51, thereafter the clamp 52 interpenetrates clamps 51 holding the gusset in position and stretched. Clamp 52 then opens and is moved away, allowing the second retractor to position the second stocking to be sewn. The sewing unit then operates the sewing of the second half perimeter of the gusset on the second stocking and sews the two stockings together.

With reference to FIGS. 20–23, the device for disposing the stocking halves on their respective stocking retractor, to be held for the sewing operation, includes at least two supports 61, one for the right retractors and the other for the left retractors, each preferably mounted for reciprocating rectilinear motion so that it can be spaced inside and away from the closed jaws 4, 6 of each retractor unit.

The supports 61 are shaped in the form of a hollow wedge with an open base and sides suitably formed with respect to the stocking to be carried. The stocking 20 after having been inserted on support 61, is then loosely tubed or pulled over onto cantilever supported jaws 4, 6, which have been closed by the movement of support 61 into the jaws 4, 6; and then the stocking is suitably stretched by closing of jaws 5, 7 which clamp the stocking 20. Thusly held, the longitudinal cut in the tubular stocking 20 wherein the two tubular stockings will be sewn together to form the pantyhose, is made (indicated by element 22 schematically shown in broken outline—see FIG. 23).

Figure 25:
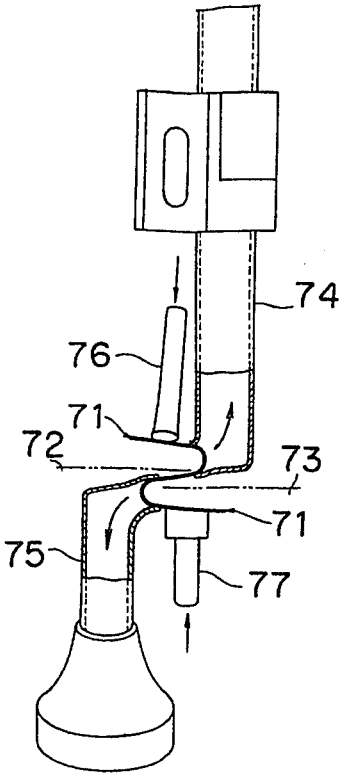
FIG. 25 is an elevational view taken along line XXV—XXV of FIG. 24.
Figure 24:
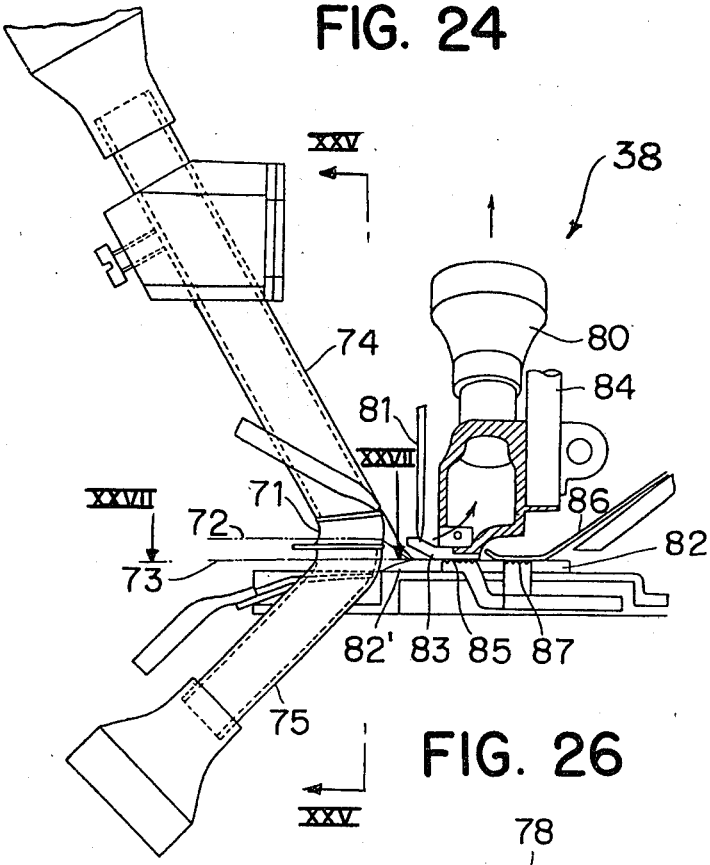
FIG. 24 is a side view of the device for guiding stocking edges which are to be sewn.
Figure 26:
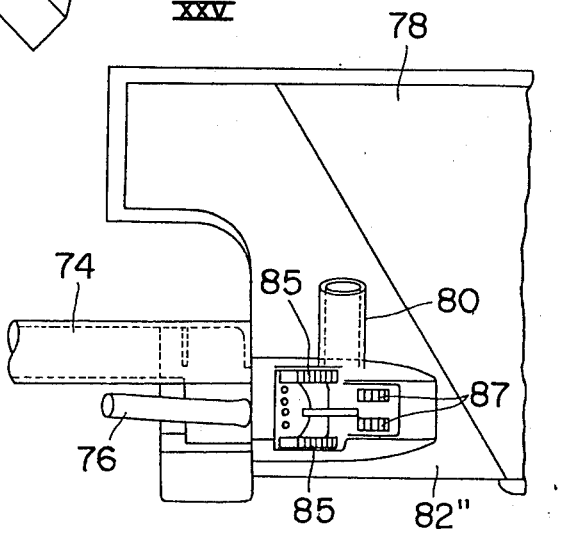
FIG. 26 is a plan view of the device of FIG. 24.
Figure 27:
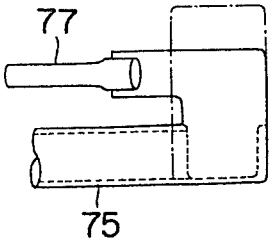
FIG. 27 is a plan view of the device for guiding stocking edges taken along the line XXVII—XXVII of FIG. 24.

With reference to FIGS. 24–27, the device for stretching the edges of the stockings to be sewn, along the whole length of the seam to be sewn, includes a baffle 71 having an "S" shaped cross-section, the loops of which are designated to hold and guide the two edges 72, 73 of the stockings 20 to be sewn. Vacuum ducts 74, 75 are provided, in a longitudinal direction, each offset to one side from baffle 71 and on opposite sides of the sewing plane, thereby causing the width of the edges 72, 73 to be stretched. These vacuum ducts 74, 75 also cooperate with ducts 76, 77, which are also positioned on opposite sides of the sewing plane as shown in FIG. 25, to provide positive air pressure for pushing the upper edge 72 of the stockings downwardly and forwardly, and to push the lower edge 73 of the stockings upwardly and forwardly. This action also results in the interposition of an air pad between the fabric and the needles 81 to facilitate advancement of the fabric into the sewing unit 78. The preferred device can rotate horizontally around an axis passing through the needles shaft. To ensure the correct entrance of the edges 72, 73 into the sewing unit, there is also provided, at the initiation of each sewing operation, an additional vacuum duct 80 in the sewing machine foot 83, that is, immediately down-stream of the needles 81. As can be readily understood, the vacuum and blowing air phases for ducts 74, 75, 76, 77 and 80, may be controlled by known means coupled to the sewing operation.

Other improvements which are preferably incorporated into the present invention device are concerned specifically with the sewing operation in order to ensure continuous operation and sewing of the edges to be joined on the stockings. These include: a needle plate 82 (FIGS. 24 and 26), the face 82' of which projects for few millimeters from the needles 81, and the surrounding zone 82'' is lowered to allow the device to guide the edges to be sewn; a double sewing machine foot made up of a front foot 83 and a rear foot 86, the rear foot 83 which is engaged with rod 84 may be raised, and is provided with a vacuum duct 80 engaged with the fabric drawing jaws 85; the rear foot 86 is independent from the front foot 83; and, front jaws 85 which are secured to plate 82 and are joined to jaw 87, to function to draw the sewing thread chain even when the front foot 83 is lifted. The construction details of these, as well as other specific elements of the present invention, may vary with respect to shape, dimensions, disposition and type of materials used, without departing from the main concept of the invention.

Figure 7:
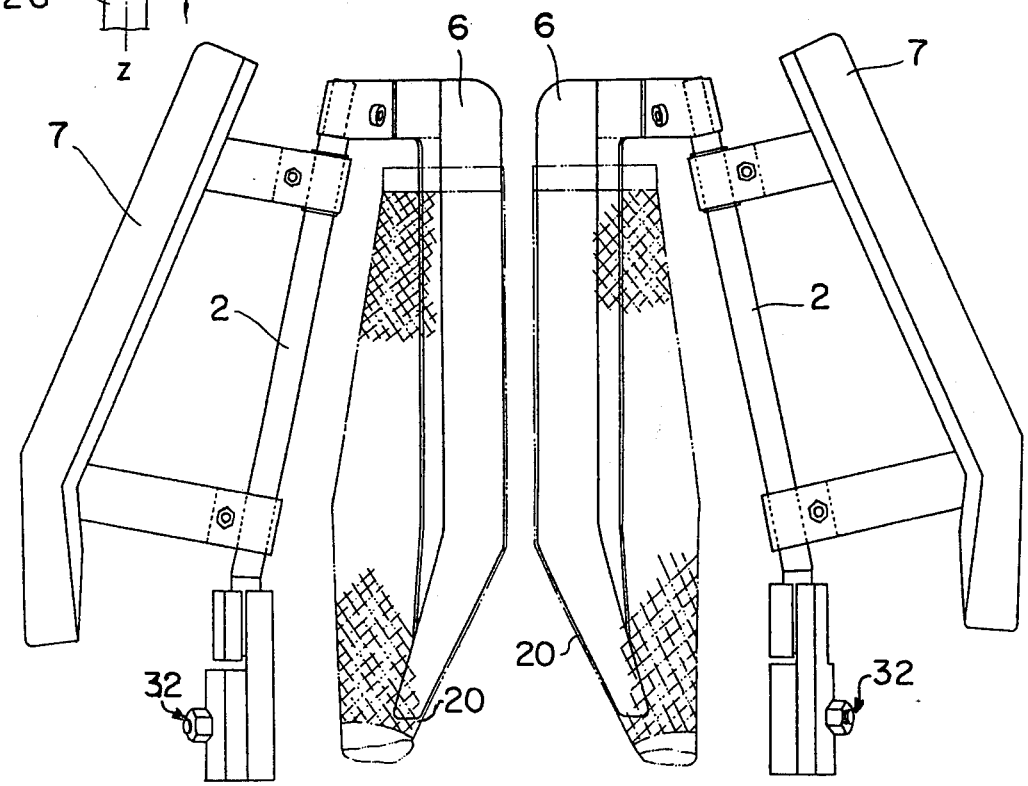
FIG. 7 is a plan view of the retractor apparatus of FIG. 1 shown in a closed position with tubed stockings on each support jaw and with the clamped jaws in an open position.
Figure 8:
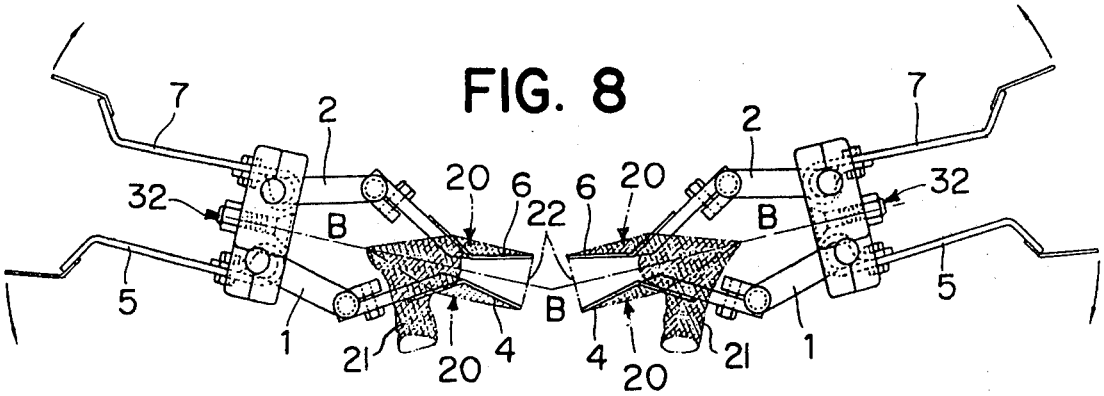
FIG. 8 is an elevational view of the retractor apparatus as shown in FIG. 7.
Figure 9:
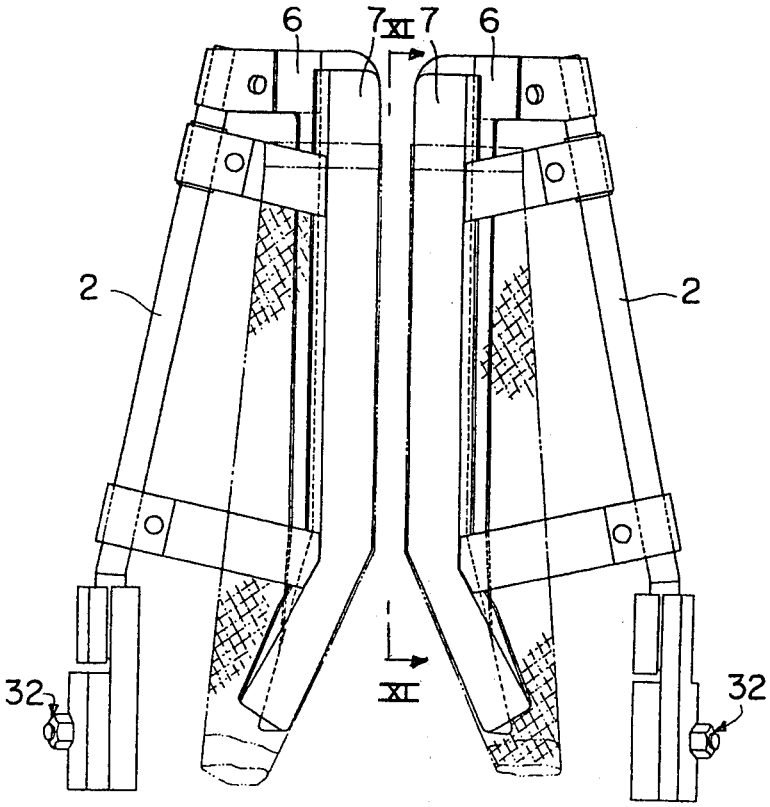
FIG. 9 is a plan view of the retractor apparatus of FIG. 1 in a closed position, with a stocking tube clamped between the two pairs of jaws with the jaws closed as in FIG. 1, and showing each stocking tube already trimmed along a longitudinal incision.

The progressive operation of the device is explained and shown by comparing FIGS. 1, 7, 9, 12, 13, 15, 18, 21 with each other (and also FIGS. 2, 8, 19, 14, 16, 19 and 23; and FIGS. 3, 11, 17), and in general the working cycle of the device is as follows:

Two stockings are tubed or pulled over the fixed jaws 4, 6 of the two arms 1, 2 of the two units of the retractor in a folded closed position, and then the two pairs of movable jaws 5, 7 are closed on jaws 4, 6, respectively (FIGS. 1, 7, 9). This clamps and locks the interposed fabric on the two stockings 20. Thereafter, two cuts 22 are made in the fabric 21 at the place thereof where the stockings 20 are to be sewn together to form the pantyhose (see especially FIG. 8, FIG. 10). The fabric is held and stretched during this operation, between the pairs of clamped jaws 4, 5 and 6, 7 along a longitudinal medium plane for a distance as required. Successively, the retractor is opened wide by rotating the two movable arms 1, 180° so as to make the jaws 4, 5 of the two arms 1 co-planar and lined up with jaws 6, 7 of the two fixed arms 2.

Thereafter, one of the two units forming the retractor group (for example that on the left hand side) is moved, by known means, to the sewing station where the gusset carrier device (FIG. 5, FIG. 20) places and holds the gusset in place as required. The gusset may be of any suitable material, including that of which the stockings are made. The gusset is held over the recessed zone of the retractor with two of its sides superposed to the ones of the first stocking which is held in position. The sewing unit then sews the gusset to the stocking along two sides thereof (FIGS. 21–27). Then the sewing unit is moved out of the way to permit the second retractor unit carrying the second stocking to be placed as required, and the first stocking carrying the half sewn on gusset is moved into place. The sewing assembly then completes the sewing of the second stocking. Thereafter, the two units of the retractor group are jointly transfered, again by known means, to the discharge station for the finished product whereat it is removed from the device by known means.

While there has been shown what is considered to be the presently preferred mode for carrying out the invention, it will be obvious that various changes and modifications may be made without departing from the scope of the invention.

What is claimed is:

1. A machine for manufacturing pantyhose with a gusset, from two tubular stockings, comprising:

stocking support means operable to support two tubular stockings which are to be sewn together to form the pantyhose, said stocking support means including retractor devices, one for each tubular stocking, each of said retractor devices being independent of each other and substantially identical with each other;

stocking cutting means for slitting each stocking along a distance where the stockings are to be sewn together to form the pantyhose;

a sewing unit to sewing unit to sew the gusset to the one stocking;

means to dispose a gusset over the cut portion of one of the stockings, said last mentioned means including means for separately holding the gusset during sewing half of the perimeter of the gusset by said single sewing unit, means including one of said retractor devices to move the other of the stockings into overlapping relationship with the gusset sewn to the one stocking; and means for moving said sewing unit to sew the one stocking to the other stocking and to the gusset.

2. A machine for manufacturing pantyhose with a gusset, from two tubular stockings, comprising:

stocking support means operable to support two tubular stockings which are to be sewn together to form the pantyhose;

stocking cutting means for slitting each stocking along a distance where the stockings are to be sewn together to form the pantyhose;

means to dispose a gusset over the cut portion of one of the stockings;

a sewing unit to sew the gusset to the one stocking;

means to move the other of the stockings into overlapping relationship with the gusset; and means for moving said sewing unit to sew the one stocking to the other stocking and to the gusset;

said stocking support means comprising a plurality of retractor devices each of which is formed of two independent and substantially identical units symmetrically disposed about a vertical longitudinal axis, each said unit including:

first and second arms;

a hinge, said hinge connecting said first and second arms to permit closing folding or opening unfolding of the arms about a transversal axis;

first and second jaws integral with a respective one of said arms, said first jaw being fixed and cantileverly supported by its respective arm, and said second jaw being pivotably mounted with respect to its respective arm, whereby said first jaw is operable to support a stocking half wherein the stocking half is clamped by said second jaws.

3. The machine of claim 2, wherein said first cantilever jaws are operable to be adjusted with respect to each other whereby they can be made co-planar when said arms are aligned.

4. A machine for manufacturing pantyhose with a gusset, from two tubular stockings comprising:

stocking support means operable to support two tubular stockings which are to be sewn together to form the pantyhose;

stocking cutting means for slitting each stocking along a distance where the stockings are to be sewn together to form the pantyhose;

means to dispose a gusset over the cut portion of one of the stockings;

a sewing unit to sew the gusset to the one stocking;

means to move the other of the stockings into overlapping relationship with the gusset; and means for moving said sewing unit to sew the one stocking to the other stocking and to the gusset;

said stocking support means comprising apparatus for stretching the edges of the stockings to be sewn along the whole length of the seam to be sewn and including a baffle having an "S" shaped cross-section, the loops of said cross-section being designed to hold and guide the two edges of the stockings to be sewn;

vacuum ducts provided in a longitudinal direction and offset to one side of said baffle on opposite sides of the sewing plane, thereby to cause the width of the edges to be stretched;

auxiliary air ducts positioned on the opposite side of the sewing plane to said vacuum ducts and operable to provide positive air pressure for pushing the upper edge of the stockings downwardly and forwardly and to push the lower edge of the stocking upwardly and forwardly.

5. The machine of claim 1, 2, or 3, wherein said means to dispose a gusset over the cut portion of the stocking comprises:

a goose neck bracket mounted at its upper end for rotation about a vertical axis;

a cantilever supported plate mounted to said bracket and being shaped to substantially correspond to the shape of the gusset to be applied; and means operably connecting said upper end of said bracket to said cantilever supported plate, to permit rotation of said goose neck bracket about said vertical axis of rotation without rotating said cantilever supported plate.

6. The machine of claim 5, wherein said means to hold cantilever supported plate from rotating when said goose neck bracket is rotated, comprises a pivot about which said goose neck bracket rotates, a first drive belt, a vertical rotatable mounted shaft, and a second drive belt, said first drive belt being connected between said shaft and said pivot; said second drive belt connecting said shaft to said cantilever supported plate.

7. The machine of claim 1 or 2, wherein said means to dispose a gusset over the cut portion of one of the stocking, when the gussets are rhombic in shape, comprises:

a plurality of first clamps, a second clamp, each of said first clamps having two flat jaws with a first opening and a central head, said central head being in the form of an isosceles triangle; the apex of said isosceles triangle being equal to the largest angle of the rhomboid-shaped gusset that is to be used and the longitudinal size of the head substantially corresponding to the length of the gusset to be used;

said second clamp including two flat second clamp jaws and a second clamp opening, said second clamp jaws and second clamp opening being sized to permit interpenetration of said second clamp into the openings of said first clamp, the head of said first clamp being sized to fit into the second clamp opening whereby the clamp holding the gusset can be interchanged without releasing the gusset;

the sewing of the gusset on the one stocking occurring while being held by said first clamps, thereafter said second clamp interpenetrating said first clamp to hold the gusset in position while said first clamps open and move away to provide clearance for the movement of the other stocking into position for subsequent sewing.

* * * * *